US005575377A

United States Patent [19]

Etani

[11] Patent Number: 5,575,377

[45] Date of Patent: Nov. 19, 1996

[54] CIGARETTE SUPPLYING APPARATUS

[75] Inventor: Tadao Etani, Tokyo, Japan

[73] Assignee: Japan Tobacco Inc., Tokyo, Japan

[21] Appl. No.: 388,458

[22] Filed: Feb. 14, 1995

[30] Foreign Application Priority Data

Feb. 15, 1994 [JP] Japan ..... 6-018067

[51] Int. Cl.[6] ..... B65G 47/56

[52] U.S. Cl. ..... 198/481.1; 198/478.1

[58] Field of Search ..... 198/443, 450, 198/478.1, 481.1, 471.1, 530, 532, 392

[56] References Cited

U.S. PATENT DOCUMENTS

| | | | |
|---|---|---|---|
| 3,039,588 | 6/1962 | Harnack | 198/481.1 X |
| 4,042,877 | 8/1977 | Sieverin | 198/481.1 X |
| 4,296,660 | 10/1981 | Cristiani | 198/450 X |
| 4,601,384 | 7/1986 | van Doren | 198/481.1 |

FOREIGN PATENT DOCUMENTS

| | | | |
|---|---|---|---|
| 0512492 | 11/1992 | European Pat. Off. . | |
| 0075723 | 4/1986 | Japan | 198/478.1 |
| 4-339714 | 11/1992 | Japan . | |
| 0783236 | 9/1957 | United Kingdom . | |
| 0839427 | 6/1960 | United Kingdom | 198/481.1 |

*Primary Examiner*—James R. Bidwell
*Attorney, Agent, or Firm*—Birch, Stewart, Kolasch & Birch, LLP

[57] ABSTRACT

A cigarette supplying apparatus is provided with supplying passages each having a lower end, and holding members each having a jaw portion directed upward from a horizontal plane. Each holding member is provided on the lower portion of each supplying passage and engageably holds a cigarette. Receiving depressions are formed in a receiving member of each receiving drum. The cigarette is disengaged from the jaw portion by the receiving member and then received in the receiving depression. Secure mechanical holding of the cigarette on the jaw portion obviates a negative pressure mechanism such as suction holes and simplifies the structure of the apparatus. Since the cigarette is disengaged from the jaw portion and then received in the receiving depression, secure operation of the apparatus is ensured.

13 Claims, 8 Drawing Sheets

~ 2 ~

CIGARETTE SUPPLYING APPARATUS

BACKGROUND OF THE INVENTION

1. Field of the Invention

The present invention relates to a cigarette supplying apparatus for supplying, one by one, a plurality of cigarettes contained randomly in a hopper in a cigarette packing apparatus, which apparatus has a simplified structure and operates accurately.

2. Description of the Related Art

In general, a cigarette packing apparatus every time takes out, one by one, the same number of cigarettes as that contained in a cigarette box, from a hopper in which many cigarettes are held randomly, piles them up in three steps and packs them with packing paper.

The conventional apparatus for supplying cigarettes one by one from a hopper has a plurality of supplying passages opened at the lower portion of the hopper. Cigarettes are supplied from the hopper to the supplying passages under the gravity. The cigarettes are arranged in a row in each supplying passage and delivered downwardly. The same number of the supplying passages as that in a cigarette box, for example, twenty are provided.

On the lower portion of each supplying passage is provided a holding member for holding the lowest one of the cigarettes arranged in a row in the supplying passage. The holding member is formed with a depression for holding a cigarette. A suction hole is formed in the inner surface of the holding member so that the hole sucks and holds the lowest cigarette under a negative pressure produced in the suction hole.

A receiving drum is formed under each supplying passage and depressions for receiving cigarettes and suction holes are formed in the peripheral surface of the receiving drum. As each receiving drum is rotated, it receives a cigarette held in the holding member on the lower portion of each supplying passage.

The cigarettes taken out in this way are transferred one by one to a series of arranging drums and piled into three steps in a staggered fashion, the first step includes seven cigarettes, the second step includes six cigarettes and the third step includes seven cigarettes. The cigarettes thus piled up in a staggered fashion are packaged together.

The cigarettes held in the holding member on the lower portion of each supplying passage must support the weight of a plurality of cigarettes arranged in the supplying passage so that they do not drop and must be transported to the respective receiving member accurately when they pass through the receiving member. Thus, with the cigarettes supported by the holding member on the lower portion of each supplying passage under a negative pressure, the holding force of the cigarettes must be adjusted delicately. When the negative pressure is too weak, the cigarettes drop from the supplying passage. When the negative pressure is too strong on the other hand, the cigarettes are likely to be damaged when they are received by the receiving member. In the conventional apparatus, negative pressure passages communicating with the suction holes opened at the receiving members and other parts have complicated structures. The holding members and the receiving members are likely to clog with shredded pieces dropping out of the cigarettes and suction forces change, making it more difficult to adjust the suction forces.

The present invention provides a cigarette supplying apparatus in which cigarettes are held securely by holding members on the lower portions of the supplying passages for securely transferring the cigarettes to receiving drums. The present invention has a simple structure.

SUMMARY OF THE INVENTION

In order to achieve the object, an apparatus according to the present invention is provided with a plurality of supplying passages each supplying cigarettes in a hopper downwardly under the gravity in a state in which the cigarettes are arranged in a row. A holding member is provided on the lower portion of each supplying passage. The holding member has a jaw shape with its front end directed upward from a horizontal plane and embraces and holds the lowest cigarette arranged in the respective supplying passage. Thus, the cigarettes arranged in each supplying passage does not drop under gravity. Receiving drums are provided under the lower portion of each receiving drum and are rotated. A receiving member projects from the peripheral surface of each receiving drum and is formed with a depression for holding a cigarette.

Since the holding member has a jaw shape with its front end directed upward, it embraces and holds the lowest cigarette in each supplying passage so that the cigarette is prevented from dropping. The cigarette is securely held without using suction holes and has a simple structure.

As the receiving drum is rotated, the receiving member abuts against the cigarette held on the jaw-shaped holding member and disengages the cigarette therefrom. Then, the cigarette is received by a receiving depression formed in the receiving member. Thus, its operation is simple and accurate.

The apparatus according to the present invention is provided with three arranging drums. In the peripheral surfaces of the arranging drums are arranged seven, six and seven cigarettes, respectively. Above the arranging drums are arranged receiving drums for receiving seven, six and seven cigarettes so as to surround the upper portions of the arranging drums. Each receiving drum is arranged on the respective supplying passage. The supplying passages extend substantially vertically in order to deliver the cigarettes under the gravity. Thus, positional relationship between the receiving drums and the corresponding supplying passages differ from one after another.

It is necessary to direct each jaw-like holding member substantially in the tangential direction of the peripheral surface of each receiving drum. When the supplying passage is located in the center over the respective receiving drum, therefore, the front end of the jaw-like holding drum is in a substantially horizontal direction and cannot embrace and hold the cigarettes.

In order to overcome such disadvantages, the jaw portion of each holding member of an embodiment of the present invention is directed slantwise upwardly so as to hold cigarettes accurately. An inclined portion is formed on the front end portion of the receiving member projecting from each receiving drum. As the receiving drum is rotated, the cigarette held by the jaw portion of the holding member abuts against the inclined portion and is pushed upwardly at first. Then, the cigarette is pushed upwardly by the front end of the jaw portion directed slantwise and upwardly. In this state, the upwardly pushed cigarettes are received by the receiving members so as to be directed in a circumferential direction, i.e., in a substantially horizontal direction. When the lower portion of the supplying passage is disposed within the range of 30° in both circumferential directions from the center over the respective receiving drum in this arrangement, the cigarette can be held securely and can be received by the receiving drum smoothly.

When the lower portion of the supplying passage is disposed in the range 30° to 50° in the circumferential direction of the receiving drum and the front end of the jaw portion of the holding member is directed in the tangential direction of the peripheral surface of the receiving drum, the jaw portion is directed slantwise and upwardly. Thus, it is unnecessary to form an inclined portion on the receiving member of the receiving drum.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1:
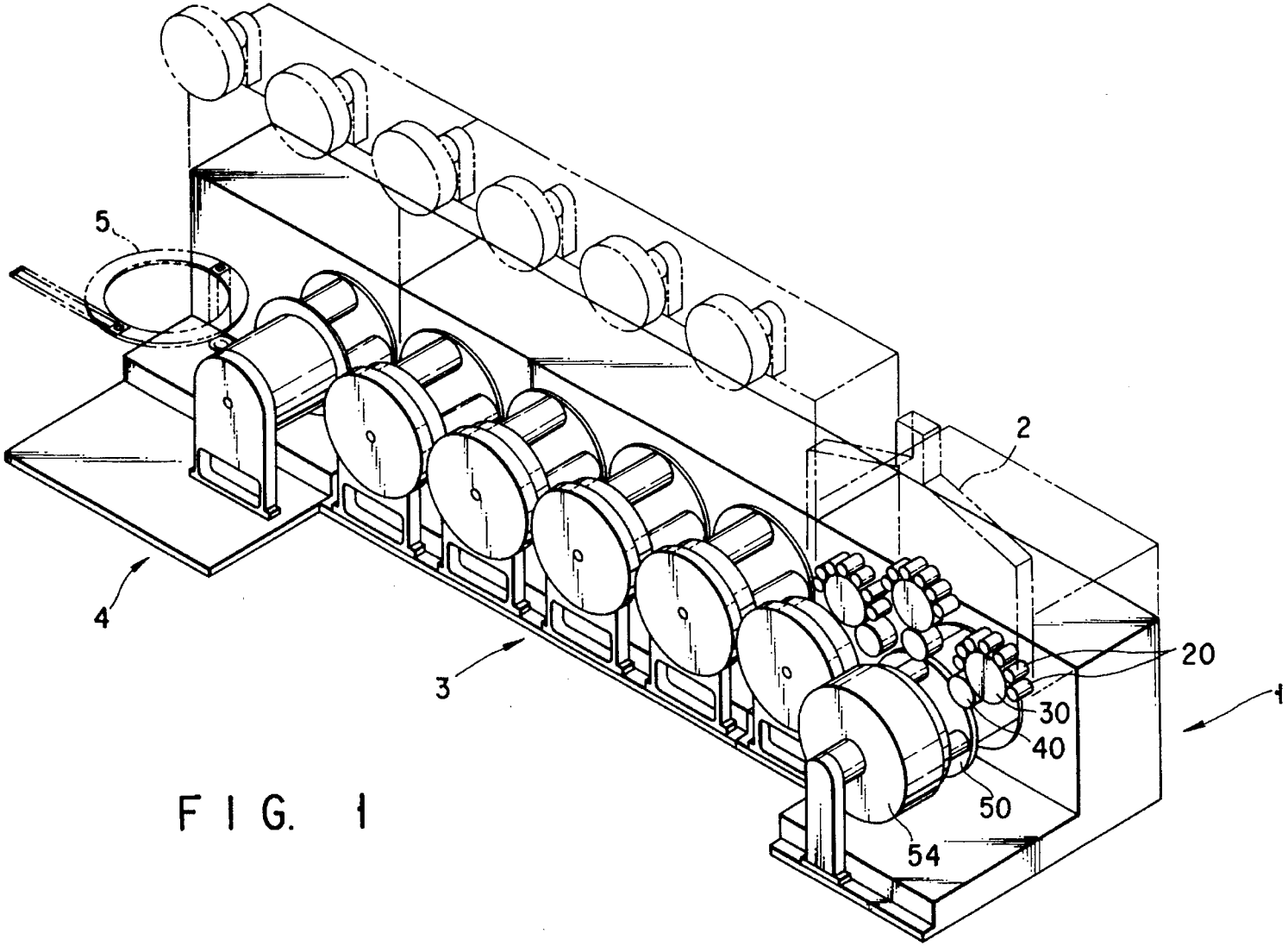
FIG. 1 is a perspective view of a whole packing apparatus.

The present invention will be described by way of embodiments with reference to the accompanying drawings. First, a packing apparatus provided with an embodiment of a cigarette supplying apparatus according to the present invention will described. This supplying apparatus packs twenty cigarettes each time. The whole packing apparatus is shown in FIG. 1. In FIG. 1, an arranging apparatus designated at 1 is provided with a hopper 2 to which many cigarettes are supplied from a cigarette manufacturing apparatus (not shown). Every twenty cigarettes corresponding to the number of cigarettes in a cigarette box are piled up to form three steps, the first step being seven cigarettes, the second step being six cigarettes and the third step being seven cigarettes.

The piled cigarettes are delivered to an adjacent packing apparatus 3 for automatically packing the cigarettes corresponding to a cigarette box with aluminum film, packing paper or the like every time.

Packages formed in this way are attached by seals or the like and discharged by a discharge conveyor 5. With the arranging apparatus 1 is provided a cigarette supplying apparatus which will be described with reference to FIGS. 2 to 10. Vertical extending supplying passages 12 being arranged in a number corresponding to the number of cigarettes in a box, i.e., twenty cigarettes are formed in the bottom of the hopper 2. The upper end of each supplying passage 12 is open to the bottom of the hopper 2. The supplying passages 12 are formed between blocks 13 and 14 and their width is slightly larger than the diameter of a cigarette C.

Mountain-shaped guide blocks 18 are attached to the upper surfaces of the blocks 13 and 14. A pair of agitator rollers are provided on both sides of the upper portion, i.e., the entrance of each supplying passage 12 for providing reciprocal rotation to introduce the cigarettes C in the hopper 2 into the corresponding supplying passage 12. The cigarettes C are guided one by one from the hopper 2 to the guide blocks 18 and delivered one by one by the agitator rollers 11 to the supplying passages 12 to be arranged in a row in the supplying passages 12. The cigarettes C arranged in a row in each supplying passage 12 are moved downwardly under gravity.

A holding member 15 is provided on the lower portion, i.e., the outlet end of each supplying passage 12. The lowest cigarette C of the cigarettes arranged in a row in each supplying passage 12 is held by the holding member 15, and is prevented from dropping. The holding member 15 and supports the weight of the cigarettes C in the supplying passage 12. A receiving drum 20 is provided on the lower end of each supplying passage 12 and rotates in the arrow direction of the arrow in FIG. 4 around its own rotary shaft 21. Two (for example) receiving members 22 are formed on the peripheral surface of each receiving drum 20. A suction hole 23 is formed in each receiving member 22 and is opened at the peripheral surface thereof.

As the receiving drum 20 is rotated, the cigarettes C held by each holding member 15 on the lower portion of each supplying passage 12 are received one by one in the depression formed in the receiving member 22 and sucked and held by a negative pressure. A piling drum 50 is provided so as to corresponding to each transporting drum 40.

Figure 2:
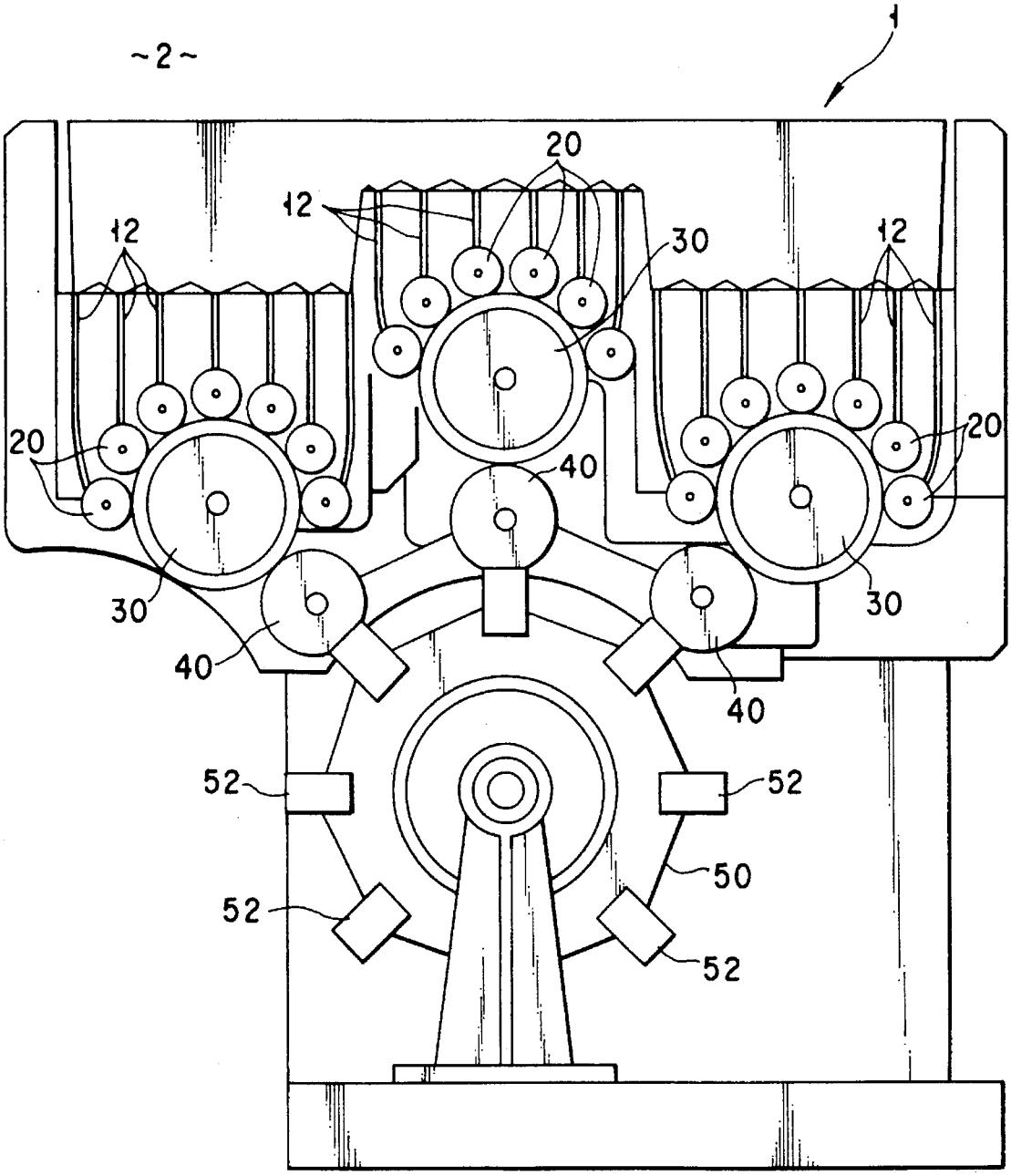
FIG. 2 is a front view of an arranging apparatus.
Figure 3:
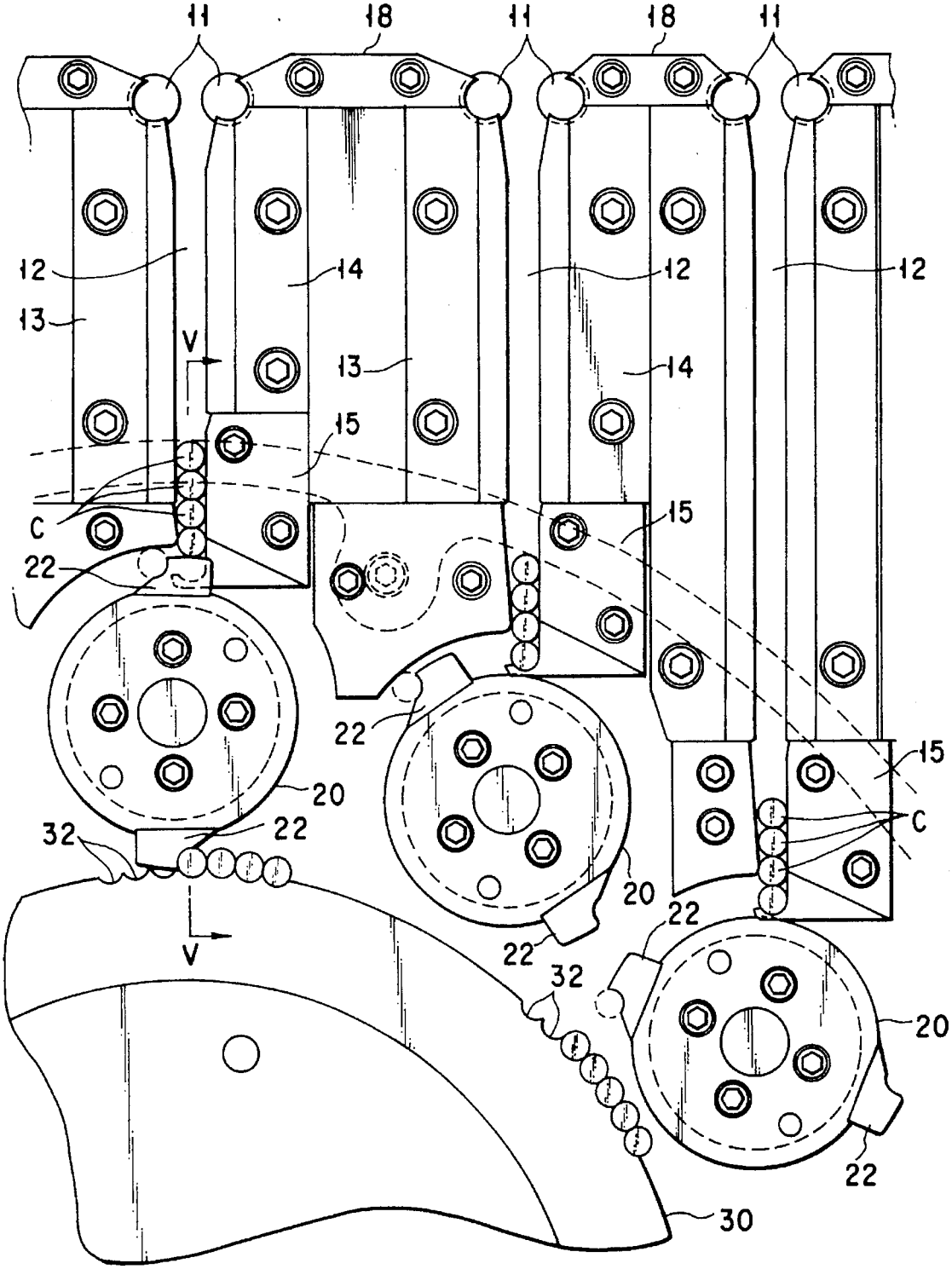
FIG. 3 is a front view of a first embodiment of a supplying apparatus according to the present invention.
Figure 4:
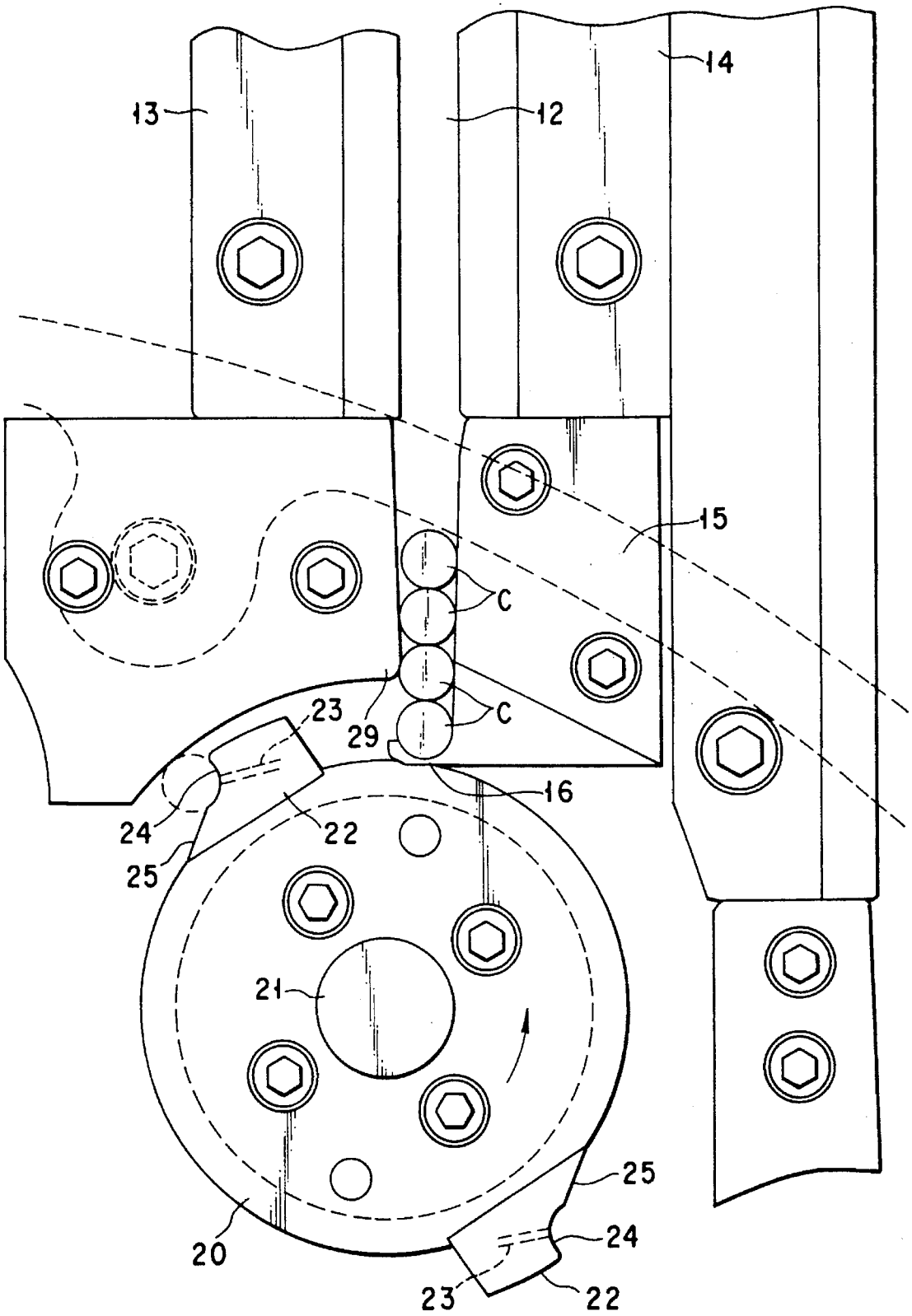
FIG. 4 is an enlarged front view of the first embodiment of the supplying apparatus.

As seen in FIG. 2, three arranging drums 30 are arranged close to seven or six receiving drums 20 correspond to the number of one row of the cigarettes C. The peripheral speed of each arranging drum 30 is set to be the spherical speed of the corresponding receiving drum 20. As shown in FIG. 3, a plurality of groups of depressions 32 are formed in the peripheral surface of each arranging drum 30. The number of each group of arranging depressions 32 is equal to the number of a row, i.e., seven or six. When each group of the arranging depressions 32 pass through the receiving drum 20, the cigarettes C are transported into the corresponding depressions 32. Although not shown in FIG. 3, the similar suction holes to the suction holes 23 are formed in each arranging depression 32 and are open at the peripheral surface thereof. The transported cigarettes C are sucked and held by a negative pressure.

Transporting drums 40 are provided so as to correspond to the arranging drums 30. A plurality of heads 52 are arranged on the peripheral surface of each piling drum 50. When the heads 52 pass by the corresponding transporting drum 50, the number of cigarettes C corresponding to the number of rows are transported one by one to form three rows of cigarettes C. In this way, twenty of cigarettes piled up in three steps and corresponding to the number in a cigarette box are packed by the packing apparatus 3.

Referring to FIGS. 3 to 10, a supplying apparatus for taking cigarettes C out one by one from each supplying passage 12 will be described. In the apparatus according to this embodiment, each of a plurality of sets of supplying apparatuses include a supplying passage 12 and a receiving drum 20. There are two kinds of supplying apparatuses, parts of which have slightly different structures designed depending on the positions at which the apparatuses are placed.

In FIGS. 3 to 8 is shown a first embodiment of a supplying apparatus which is placed within a range 0° to 30° measured from the top of the peripheral surface of the corresponding receiving drum 20 so as to face the peripheral surface.

Each holding member 15 extends from the side wall opposite to the rotational direction of the receiving drum 20 (the upstream side of the rotational direction) toward the rotational direction. A jaw portion 16 extends from the front end of each holding member 15 toward the lower end of the supplying passage 12. The front end of the jaw portion 16 is directed upwardly from a horizontal plane and mechanically embraces and holds the lowest cigarette C. The lowest cigarette C is embraced and held by the jaw portion 16 so that the cigarettes are prevented from dropping and their weight is supported in the supplying passage 12. The cigarette is held mechanically securely by the jaw portion 16. Since it is unnecessary to suck and hold the lowest cigarette under a negative pressure, no suction holes nor negative passages are formed in the holding member 15.

The supplying apparatus according to the first embodiment is arranged within the range 0° to 30° and the inclination of the tangent of the peripheral surface of the receiving drum 20 from a horizontal plane is at most 30° within this range. It is necessary to direct the front end of the jaw portion 16 in a relatively large upwardly direction in order to hold the cigarette C stably. When the supplying apparatus is within this range, the angle of the front end of the jaw portion 16 does not coincide with the direction of the tangent of the peripheral surface of the receiving drum 20 at its position but is directed more upwardly than the direction of the tangent.

A receiving depression 24 for holding a cigarette is formed in the front end of the receiving member 22 of each receiving drum 20. In the front portion of the receiving member 22 is formed an inclined portion 25 which is continuous from the lower edge of the front end of the receiving depression 24 to the peripheral surface of the receiving drum 20 so as to incline with respect to the peripheral surface of the receiving drum. The suction hole 23 is opened at the inner surface of the receiving depression 24 and connected to a negative pressure mechanism (not shown) through a pressure passage and the like.

Figure 5:
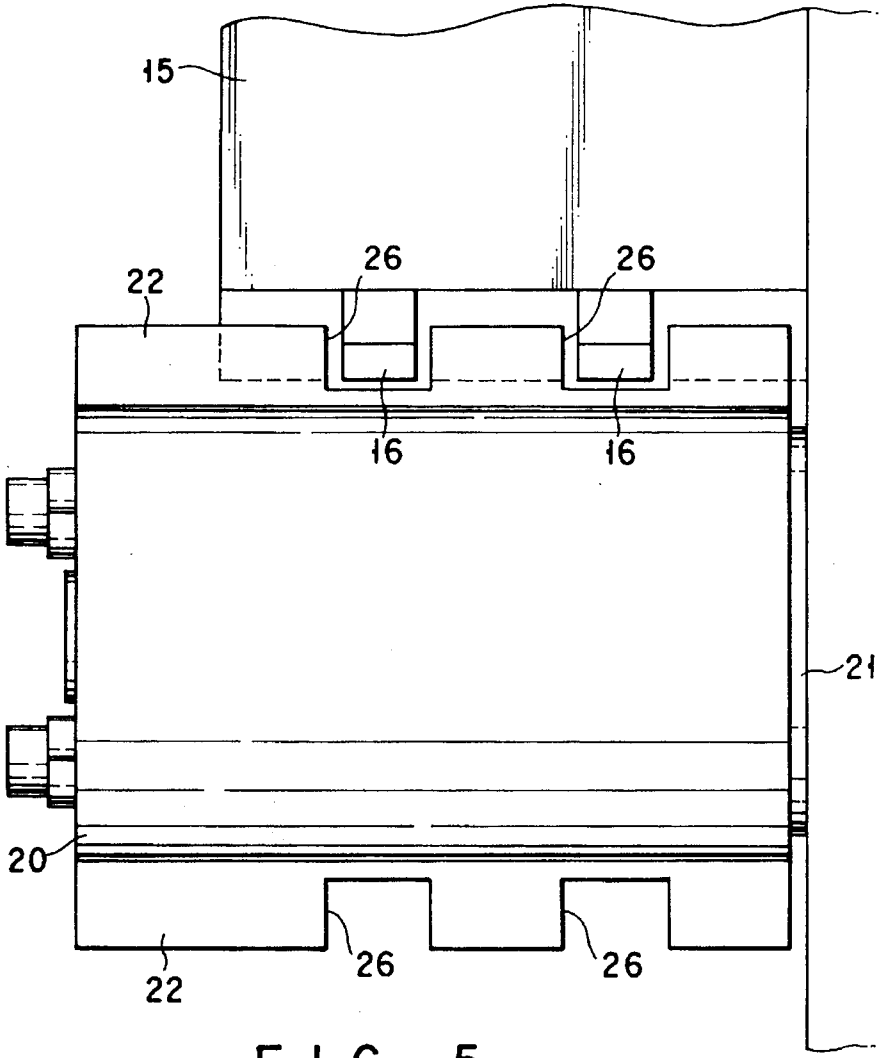
FIG. 5 is a cross sectional view taken along line 5—5.

As shown in FIG. 5, the receiving member 22 extends over the substantially the whole length of a cigarette C. Two jaw portions 16 having a small width project from and are provided on the holding member 15. Cutouts 26 are formed in the receiving member 22 so as to avoid interference with the jaw portions 16. A predetermined space is formed between the front end of each jaw portion 16 and the lower portion 29 of the side wall of the corresponding supplying passage 12 at the side of the rotational direction of the receiving drum 20. The space is selected so that only the lowest cigarette C is movable in the peripheral direction of the receiving drum 20 and the cigarette right above the lowest cigarette abuts against the lower end portion 29 and is immovable so as not to be taken out together with the lowest cigarette C.

Figure 6:
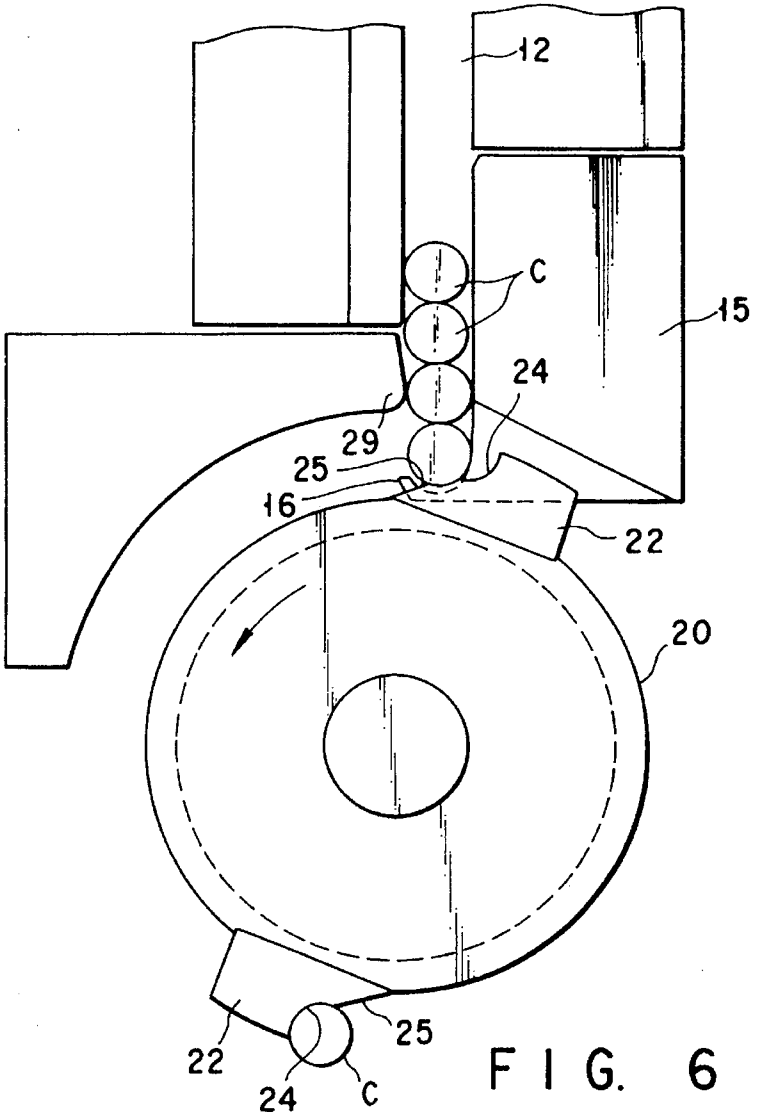
FIG. 6 is a front view illustrating the function of the first embodiment of the supplying apparatus.
Figure 8:
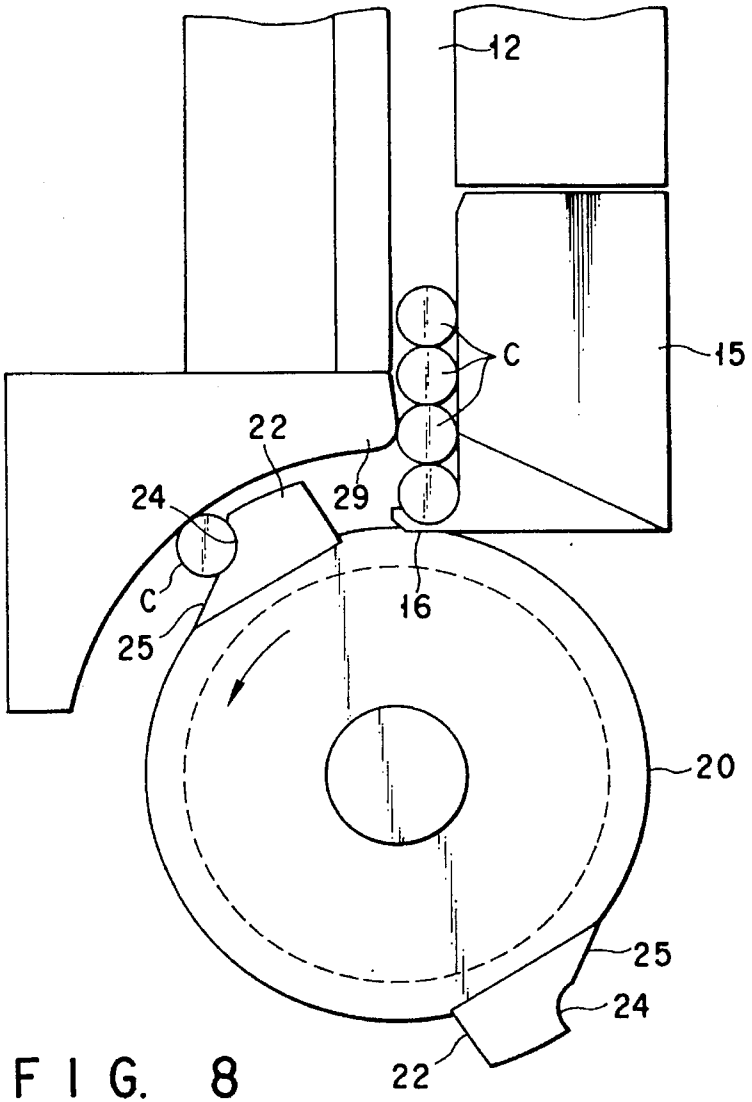
FIG. 8 is a front view showing a further state of the first embodiment of the supplying apparatus.
Figure 7:
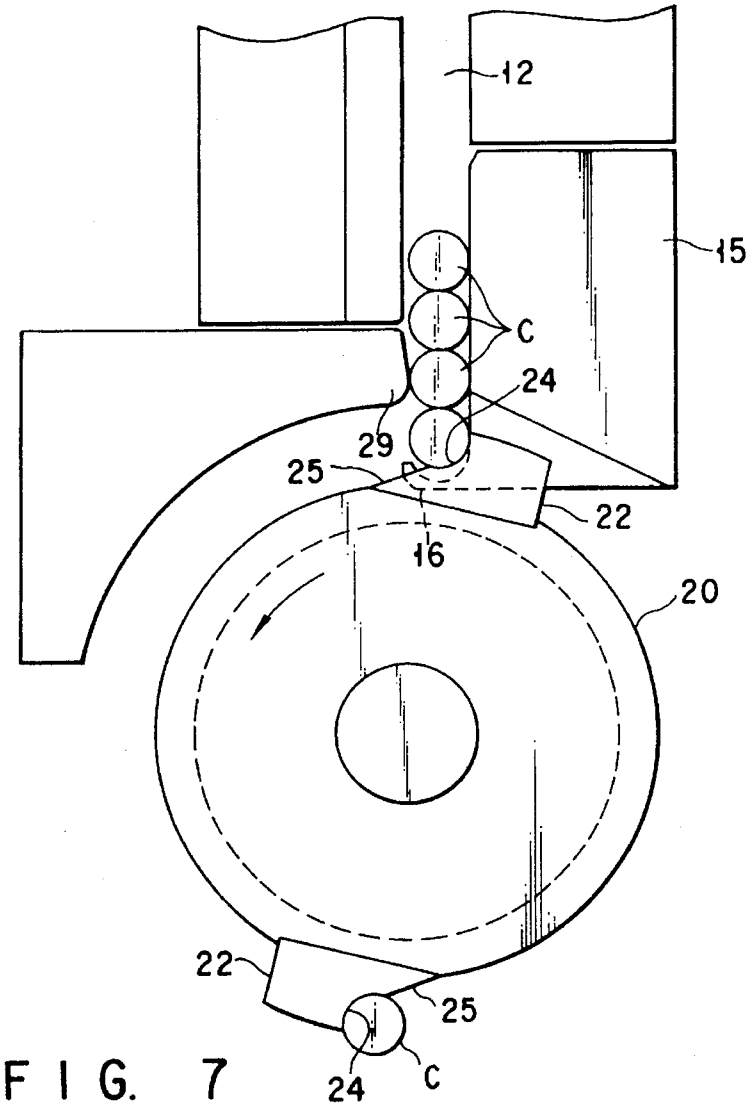
FIG. 7 is a front view showing another state of the first embodiment of the supplying apparatus.

The operation of the supplying apparatus will be described with reference to FIGS. 6 to 8. The lowest cigarette C in the supplying passage 12 is engaged with and is held by the jaw portion 16. As the receiving drum 20 is rotated as shown in FIG. 6, the receiving member 22 abuts against the cigarette held by the jaw portion 16. Since the angle of the front end of the jaw portion 16 of the holding member 15 as described above does not coincide with the direction of the tangent, the lowest cigarette C held by the jaw portion 16 cannot be moved in the direction of the tangent of the receiving drum 20 as it is. Thus, the cigarette C abuts against the inclined portion 25 at first and then is pushed upwardly along the inclined portion 25 as shown in FIG. 7. The cigarette C is disengaged from the jaw portion 16 and then engages the receiving depression 24 of the receiving depression 22. The cigarette C is sucked and held by the negative pressure acting on the suction on the suction hole 23 formed opened at the receiving depression 24. As the receiving drum 20 is rotated, the lowest cigarette C is take out of the jaw portion 16 in a state in which the lowest cigarette C is held as shown in FIG. 8. The cigarette C in the supplying passage 12 is lowered under gravity and the next cigarette is engageably held by the Jaw portion 16. This operation is repeated and the cigarettes C are taken out one by one from the supplying passage 12.

Since the supplying apparatus of the first embodiment receives cigarettes after they have been pushed upwardly and have been disengaged from the jaw portion 16, the front end of the jaw portion 16 can be set to be directed sufficiently upwardly from a horizontal plane regardless of the direction of the tangent of the peripheral surface of the receiving drum 20. Since the cigarettes are engageably held mechanically by the jaw portion 16, they are held securely and they need not be sucked and held by a negative pressure unlike the conventional apparatus. Thus, the structure of the apparatus is simplified. The cigarettes can be taken out of the jaw portion 16 merely by a simple pushing operation by the inclined member 25 of the receiving member 22. Therefore, adjustment of the suction holding force and the like are not required unlike the conventional apparatus and the operation of the apparatus of this embodiment, and its operation is simple.

Figure 9:
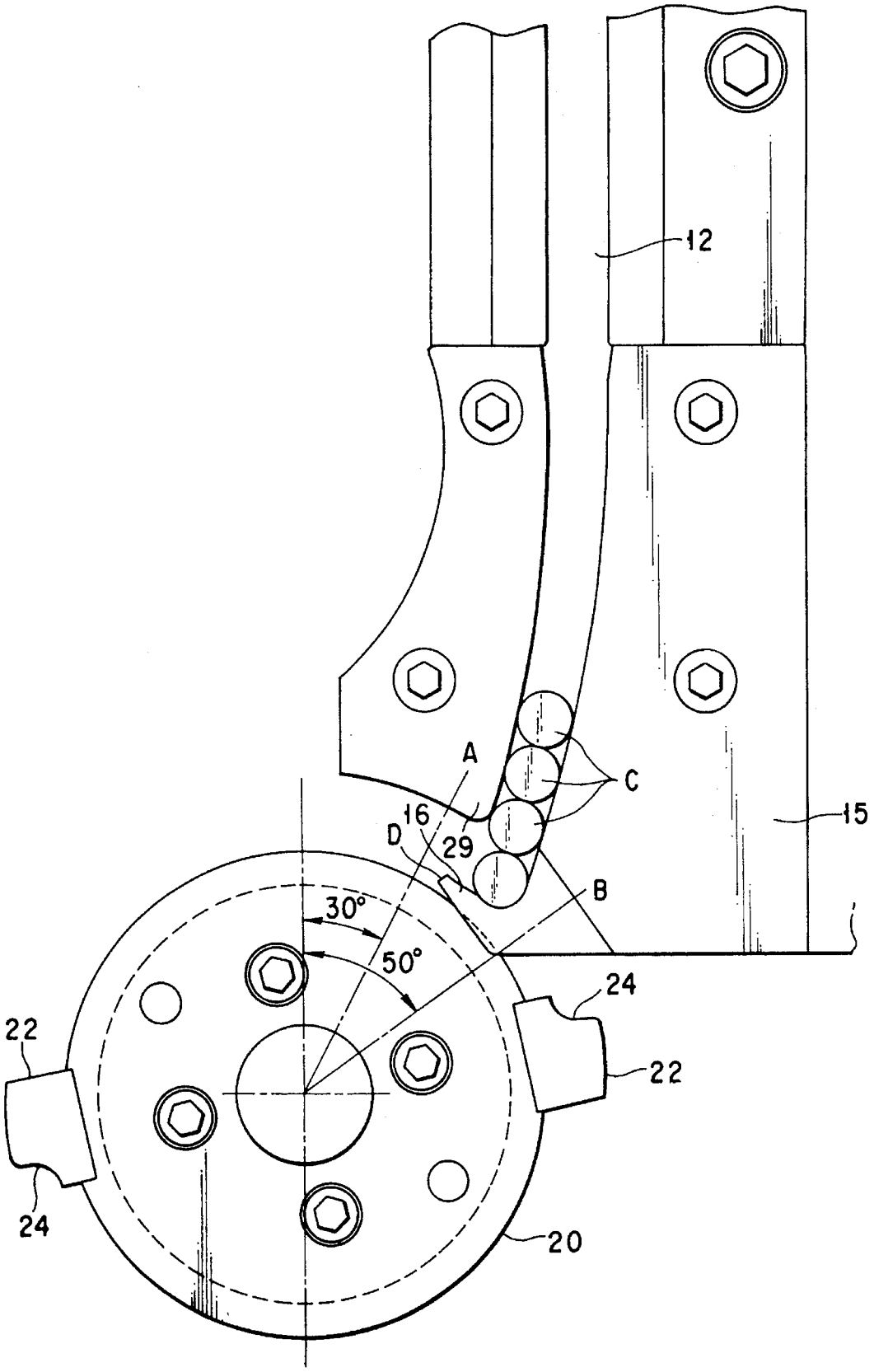
FIG. 9 is a front view of a second embodiment of a supporting apparatus.

In FIG. 9 is shown a supplying apparatus according to a second embodiment of the present invention in which the lower portion of a supplying passage 12 corresponds to the portion of the peripheral surface of a receiving drum 20 which is in the range between 30° and 50° measured from the top of the peripheral surface. The lower portion of each arranging passage 12 faces the range of the receiving drum 20 between line A and line B, i.e., the range between 30° and 50° measured from the top of the peripheral surface of the receiving drum 20. The direction of the front end of the jaw portion 16 substantially coincides with the direction of the tangent of the peripheral surface of the receiving drum 20.

The supplying apparatus of the second embodiment does not have inclined portions unlike the supplying apparatus of the first embodiment. In the supplying apparatus of the first embodiment, the receiving depression 24 of each receiving member 22 directly abuts against the cigarette held by the jaw portion 16 when the receiving drum 20 is rotated. The other structures of the supplying apparatus of the second embodiment are the same as those of the supplying apparatus of the first embodiment.

As the receiving drum 20 of the supplying apparatus of the second embodiment, the receiving depression 24 of each receiving member 22 directly abuts against and then holds the cigarette C held by the jaw portion 16 to move it in the peripheral direction. The jaw portion 16 is directed in the direction of the tangent of the peripheral surface of the receiving drum 20. The cigarette C is moved without interfering with the jaw portion 16 and is disengaged therefrom to be received by the receiving depression 24 as it is. The supplying apparatus of the second embodiment does not require inclined portions and has a simple structure, operates simply and can receive the cigarette smoothly.

The cigarette C is received without being pushed up in the supplying apparatus of the second embodiment as described above. Naturally, the space between the front end of the jaw portion 16 and the portion of the lower portion 29 of the opposite side wall is set to allow the movement of only the lowest cigarette and to prevent the next cigarette just above the lowest cigarette from being moved so as not to be taken out together with the lowest cigarette.

The lower portion of the supplying passage 12 of the supplying apparatus of the second embodiment corresponds to the range of the peripheral surface of the receiving drum 20 between 30° and 50° measured from the top of the peripheral surface. Thus, the cigarette can be received smoothly without using the inclined portions.

If the lower portion of the supplying passage is positioned within the range less than 30° and the angle of the front end of the jaw portion 16 is made to coincide with the angle of the direction of the tangent of the peripheral surface of the receiving drum 20, the angle of the front end of the jaw portion becomes too small and the lowest cigarette C cannot be held securely. If the lower portion of the supplying passage is positioned within the range more than 50°, the angle of the direction of the lower portion of the supplying passage 12 and the angle of the direction of the tangent of the peripheral surface of the receiving drum 20, i.e., the angle of the taking-out direction become too small.

If the space between the front end of the jaw portion 16 and the lower portion 29 of the side wall of the supplying passage 12 is set to a value to allow the cigarette to be taken out in the peripheral direction, the actual straight direction between the jaw portion 16 and the lower portion 29 becomes more than twice the length of two cigarettes. When the lower cigarette is taken out, the next cigarette is likely to be taken out too. Therefore, the range between 30° and 50° is preferable in the supplying apparatus of the second embodiment.

When other conditions as such the shape of the jaw portion, the shape of the supplying passages and the like are satisfied wherein the lowest cigarette can be embraced securely and the next cigarette is not taken out together with the lowest cigarette, the range is naturally not limited to the value between 30° and 50°.

Although the supplying apparatus is not located in a range more than 50°, it is also possible to arrange the supplying apparatus in such a large range as long as the above conditions are satisfied.

Figure 10:
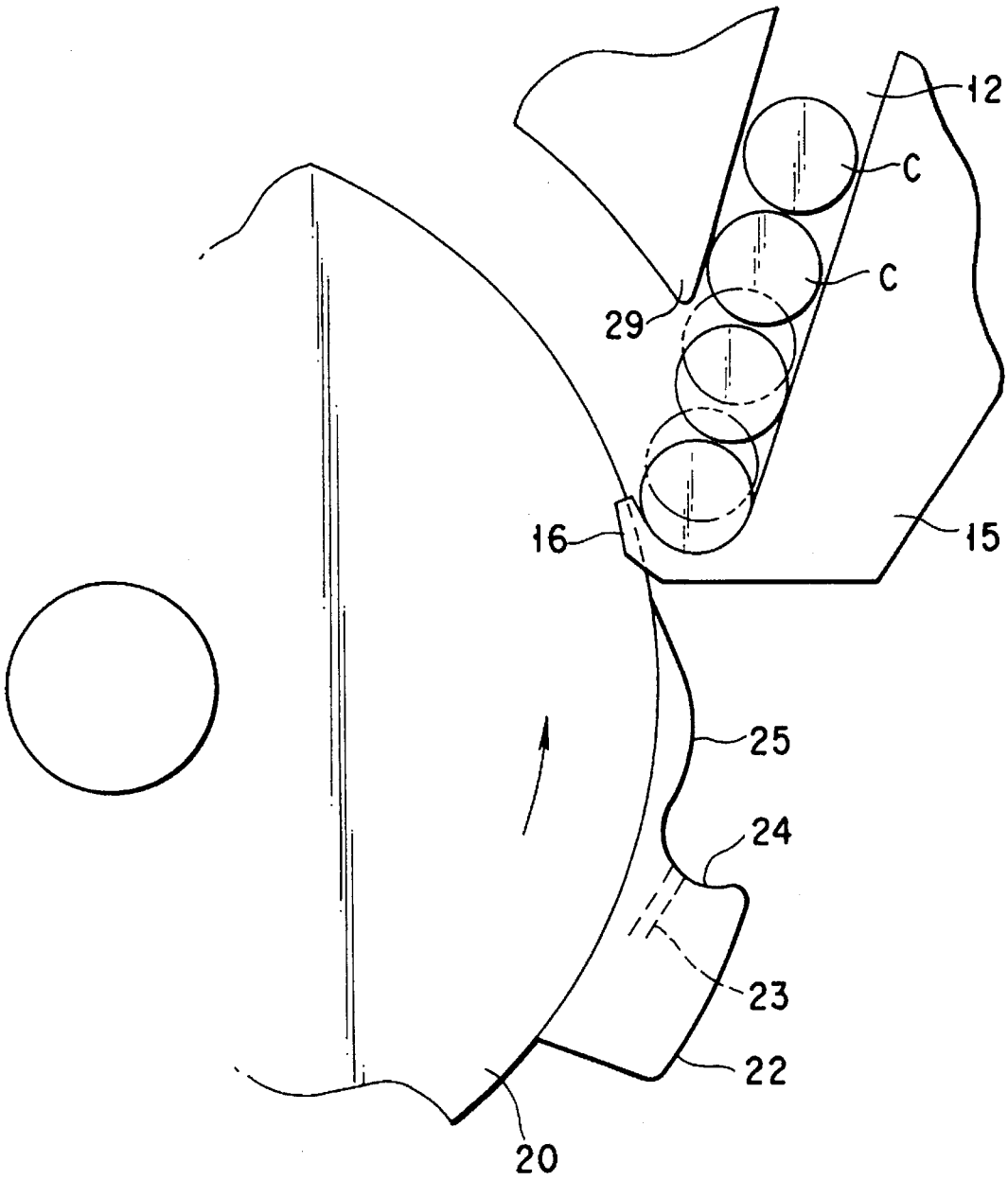
FIG. 10 is a front view of the first embodiment of the supplying apparatus which is disposed at another position.

In FIG. 10 is shown a supplying apparatus which is the same as the supplying apparatus of the first embodiment and arranged in a range more than 50°. If any means is not provided, the angle of the direction of the lower portion of the supplying passage 12 and the angle of the direction of the tangent of the peripheral surface of the receiving drum 20 are small and the space between the front end of the jaw portion 20, i.e., the angle of the side wall of the lower portion of the cigarette is set to a value at which a cigarette can pass in the taking-out direction, the actual straight distance between the front end of the jaw portion 16 and the lower portion 29 of the side wall becomes larger than twice the length of a cigarette and the next cigarette is likely to be taken out.

Since the angle of the front end of the jaw portion 16 can be made large enough in this embodiment, the angle is made to coincide with the angle of the direction of the receiving drum 20. Inclined portions 25 having a relatively large stroke are provided on each receiving member 22 in order to prevent the next cigarette from being taken out. The cigarette is pushed upwardly once and then received in the receiving depression 24.

Since the cigarettes in the supplying passage 22 are pushed upwardly by the inclined portion 25 as shown by two-dot chain lines, the next cigarette is pushed upwardly by the lower portion 29 of the side wall and the lower cigarette is received in the receiving drum 20 in a state extending in the peripheral direction. Thus, the next cigarette is securely prevented from being taken out together with the lowest cigarette.

The present invention is not limited to the above-mentioned embodiments. For example, the supplying apparatuses of the first and second embodiments which are slightly different from each other are used. However, the whole supplying apparatuses may be used which have the same structure as those of the first embodiment each having inclined portions. Alternatively, the whole supplying apparatuses may be used which have the same structure as those of the second embodiment with the lower portions of the supplying apparatuses arranged in a suitable position in a range between 30° and 50°, for example. Each of the supplying apparatuses have twenty supplying passages and twenty receiving drums. However, the number of the receiving drums is not limited thereto.

The supplying apparatuses according to the present invention can be assembled into packing apparatuses as described above. However, this invention can be used as any other cigarette supplying apparatus.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An apparatus having supplying passages for transporting cigarettes downwardly in a row under a weight of the cigarettes and designed to supply the cigarettes forwardly one by one, said apparatus comprising:

holding members provided at lower portions of said supplying passages, each for holding the lowest one of the cigarettes being transported downwardly, each of said holding members having a jaw directed upwardly from a horizontal plane; and rotatable receiving drums provided under the lower portions of said supply passages, each drum having a peripheral surface and receiving members projecting from the peripheral surface, each receiving member having a depression for holding one cigarette;

wherein the cigarettes are released from the jaws of said holding members, transported hence to said receiving means and held in said depressions, as said receiving drums are rotated;

each of the jaws of the holding members located at a lower end portion of part of said supplying passages extends along a tangent line to the peripheral surface of the corresponding one of said receiving drums, each of the receiving members of the receiving drums includes a front end and an inclined portion extending from the front end to the peripheral surface of the corresponding one of said receiving drums;

said inclined portion abuts on the cigarette held in the corresponding one of said holding members when the corresponding one of said receiving drums is rotated, and pushes the cigarette upwardly from said holding member and into the depression of said receiving member; and a space provided between the jaw of said holding member and a lower portion of a side wall of the corresponding one of said supplying passages, said space being large enough to allow passage of only the lowest cigarette pushed upwardly by the inclined portion of the corresponding one of said receiving members;

the depression of each receiving member abuts a cigarette held by the corresponding one of said holding members when the corresponding one of said receiving drum is rotated, thereby to move the cigarette along the peripheral surface of said receiving drum, to release the cigarette from the corresponding one of said holding members and to hold the cigarette in the depression.

2. The apparatus according to claim 1, wherein each of said depressions has an inner surface having a suction hole with a negative pressure for holding a cigarette in said depression.

3. The apparatus according to claim 1, wherein said supplying passages extend substantially vertically downwardly from a hopper for supplying a continuous stream of cigarettes.

4. The apparatus according to claim 3, wherein said holding members are mounted at a lower portion of each of said supplying passages and said rotatable receiving drums are mounted in an offset relationship relative to said holding members for enabling said rotatable receiving drums to position said receiving members within said space for removing a cigarette therefrom.

5. The apparatus according to claim 3, wherein said peripheral surface of each of said receiving members momentarily supports a penultimate cigarette in each of said supplying passages as a lowermost cigarette is removed by said receiving member.

6. The apparatus according to claim 3, wherein each of said holding members includes two jaws directed upwardly from a horizontal plane.

7. An apparatus having supplying passages for transporting cigarettes downwardly in a row under gravity for supplying the cigarettes one by one, said apparatus comprising:

holding members provided at lower portions of said supplying passages, each for holding the lowest cigarette of the cigarettes being transported downwardly, each of said holding members having a jaw directed upwardly from a horizontal plane; and rotatable receiving drums provided directly under the lower portions of said supply passages, each drum having a peripheral surface and receiving members projecting from the peripheral surface, each receiving member having a depression for holding one cigarette;

each of the jaws of the holding members located at a lower end portion of part of said supplying passages extends along a tangent line to the peripheral surface of the corresponding one of said receiving drums, each of the receiving members of the receiving drums includes a front end and an inclined portion extending from the front end to the peripheral surface of the corresponding one of said receiving drums;

said inclined portion of said receiving members abuts a cigarette held in the corresponding one of said holding members when the corresponding one of said receiving drums is rotated, and pushes the cigarette upwardly from said holding member and into the depression of said receiving member; and a space provided between the jaw of said holding member and a lower portion of a side wall of the corresponding one of said supplying passages, said space being large enough to allow passage of only the lowest cigarette pushed upwardly by the inclined portion of the corresponding one of said receiving members;

wherein the cigarettes are tangentially released from the jaws of said holding members, transported hence to said receiving means and held in said depressions, as said receiving drums are rotated.

8. The apparatus according to claim 7, wherein each depression of each receiving member abuts a cigarette held by the corresponding one of said holding members when the corresponding one of said receiving drum is rotated, thereby to move the cigarette along the peripheral surface of said receiving drum, to release the cigarette from the corresponding one of said holding members and to hold the cigarette in the depression.

9. The apparatus according to claim 7, wherein each of said depressions has an inner surface having a suction hole with a negative pressure for holding a cigarette in said depression.

10. The apparatus according to claim 7, wherein said supplying passages extend substantially vertically downwardly from a hopper for supplying a continuous stream of cigarettes.

11. The apparatus according to claim 10, wherein said holding members are mounted at a lower portion of each of said supplying passages and said rotatable receiving drums are mounted in an offset relationship relative to said holding members for enabling said rotatable receiving drums to position said receiving members within said space for removing a cigarette therefrom.

12. The apparatus according to claim 10, wherein said peripheral surface of each of said receiving members momentarily supports a penultimate cigarette in each of said supplying passages as a lowermost cigarette is removed by said receiving member.

13. The apparatus according to claim 10, wherein each of said holding members includes two jaws directed upwardly from a horizontal plane.

* * * * *